United States Patent [19]

DePauli

[11] Patent Number: 4,939,428

[45] Date of Patent: Jul. 3, 1990

[54] TOUCH SWITCHING SYSTEM

[75] Inventor: John F. DePauli, San Diego, Calif.

[73] Assignee: Westek Associates, San Diego, Calif.

[21] Appl. No.: 148,767

[22] Filed: Jan. 26, 1988

[51] Int. Cl.[5] ..... H05B 37/02; H05B 41/04; H05B 41/18; G05F 1/10

[52] U.S. Cl. ..... 315/291; 200/5 A; 315/362; 315/DIG. 4

[58] Field of Search ..... 307/116, 114; 315/74, 315/291, 194, 199, DIG. 4, 362; 200/5 A, 292, 512

[56] References Cited

U.S. PATENT DOCUMENTS

| | | | |
|---|---|---|---|
| 4,125,934 | 11/1978 | Keough et al. | 200/5 A |
| 4,129,758 | 12/1978 | Gilano et al. | 200/5 A |
| 4,180,711 | 12/1979 | Hirata et al. | 200/5 A |
| 4,359,670 | 11/1982 | Hosaka et al. | 315/307 |
| 4,649,323 | 3/1987 | Pearlman et al. | 315/307 |

*Primary Examiner*—Eugene R. LaRoche
*Assistant Examiner*—Ali Neyzari
*Attorney, Agent, or Firm*—Brown, Martin, Haller & McClain

[57] ABSTRACT

The described embodiment of the present invention provides a very low pressure electrical switch for use in brightness control of lamps. The electrical switch includes a flexible membrane on which printed leads are interlaced in a regular fashion. Portions of the interlaced electrical leads are exposed. The membrane is fastened to the surface of a rigid surface. In the area under the exposed conductor, a fixed conductor is formed. The membrane is fastened to the surface of the rigid surface so that a very small spacing is maintained between the exposed conductors and the fixed conductor. Because of this small spacing, a very light touch is required to cause the exposed conductors to be shorted to the fixed conductor. A microprocessor then determines which leads of the membranes are shorted together and causes the light to dim appropriately. The lighting system also contains a delay off feature in which the microprocessor causes a discernible dimming to occur when the delay off feature switch is pressed but which does not shut off the lamp until a fixed period of time has passed, thereby allowing the operator to leave the room completely before the lamp is shut off.

9 Claims, 3 Drawing Sheets

TOUCH SWITCHING SYSTEM

FIELD OF THE INVENTION

The present invention relates to the field of electrical switching. More specifically, the present invention relates to the field of highly sensitive touch switching.

BACKGROUND OF THE INVENTION

Touch control of lamp switching has been used for many years. People have found that touch switching of lamps is easy and aesthetically pleasing. However, the incorporation of dimming schemes for lamps with touch control required complex touch sequences which proved annoying. One method of touch switching that can incorporate a variety of lighting levels in one's touching system is membrane switching. However, present membrane switching techniques have a number of drawbacks which seriously limit their suitability for many applications.

These limitations include relatively high actuation force requirements which reduce their aesthetic appeal; and their utility for those with limited hand or finger mobility or strength.

Present membrane switch construction techniques also require a separate polymer 'spacer' and two layers of adhesive between the membrane which is touched and the backing of the membrane switch, adding to the cost and complexity of these switches.

The subject invention overcomes these limitations.

Another inadequacy for prior techniques for switching lamps is that all lamp switching systems at present turn the lamp completely off before the user can leave the room. Thus, the user must fumble in the dark to leave the room or leave the lamp on.

SUMMARY OF THE INVENTION

The described embodiment of the present invention includes a touch dimming system providing a very light touch while allowing a large number of switching gradations to be monitored by a lamp control system. The touch pad itself consists of multiple interleaved conductors printed on a semi-flexible material. The semi-flexible material is mounted on a very rigid plastic base. This semi-flexible membrane is attached directly to the rigid base with a single thin layer of adhesive. The adhesive layer serves as the 'spacer'. The plastic base has a recessed portion in which a conductor region is mounted. The recessed portion is positioned so that it is directly beneath exposed portions of the conductors printed on the semi-flexible membrane. Because of the extremely small spacing between the membrane and the rigid base and because of the rigidity of the base, a very light touch will cause the exposed conductors to come in contact with the conductive element, shorting them together. Because of the extremely small spacing provided by this construction technique, an extremely light touch is required to actuate the switch rendering it far more aesthetically pleasing and more suitable for use by those with limited finger mobility.

In one embodiment of the invention, a precision recess is molded into the rigid plastic base, which recess precisely accommodates the thickness of a hot-stamped or printed-on conductor. A microprocessor constantly polls the interleaved conductors to determine which are shorted together and provides a control signal to a triac which alters the dimming level of the light appropriately. Using normal lithography techniques to form the conductors, a very large number of gradations may be monitored and nearly continuous dimming may be provided.

An additional feature of the described embodiment is a delay-off feature to allow a user to leave the room before the lamp turns off. When the touch pad is switched to the delay-off mode, the lamp immediately dims to indicate to the user that the delay-off has taken effect. A microprocessor then holds the dimmed position and counts a fixed period of time before turning off the lamp. Thus a person has time to leave the room before the room goes dark.

DETAILED DESCRIPTION OF THE PREFERRED EMBODIMENT

Figure 1:
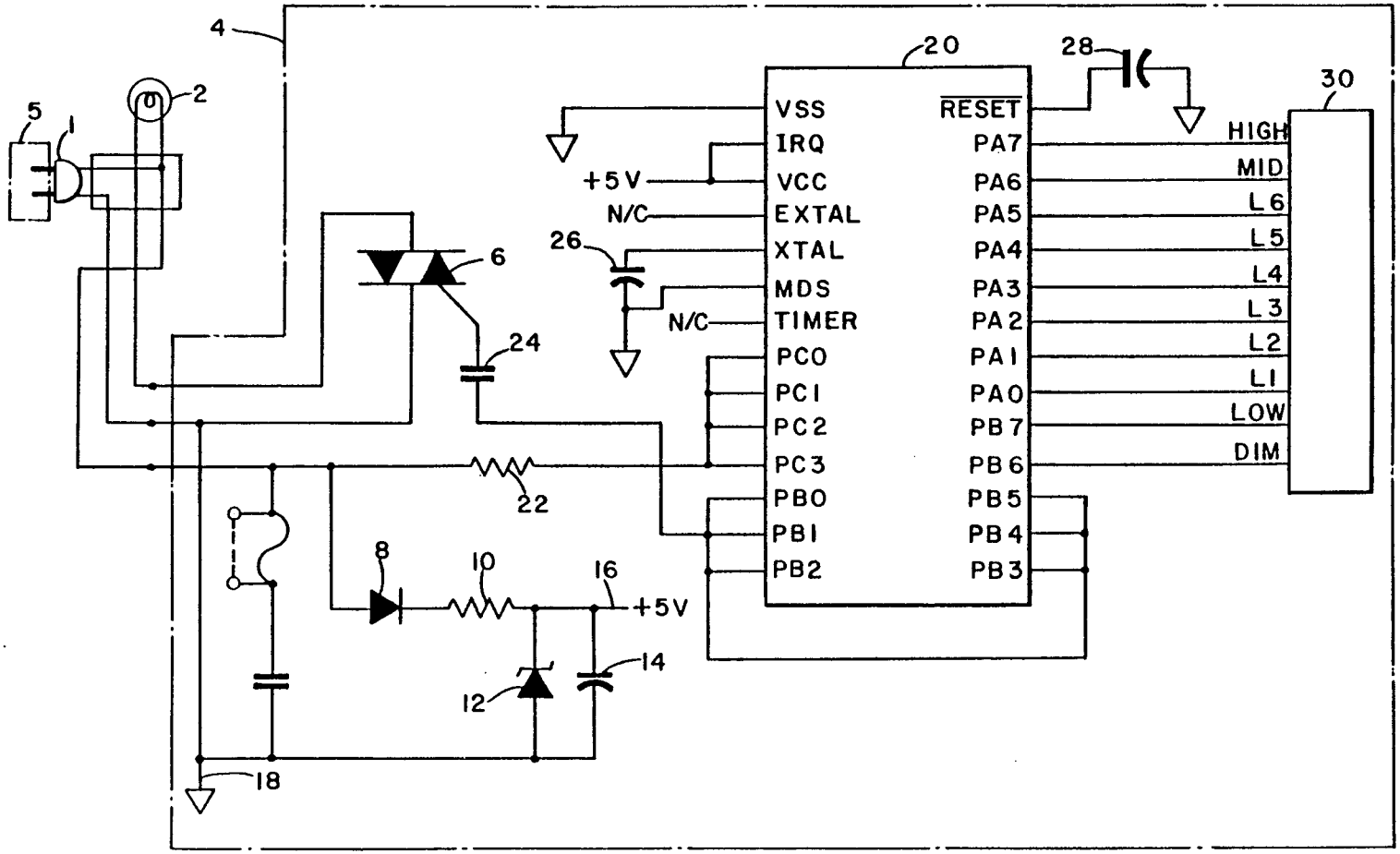
FIG. 1 is a schematic diagram of control circuitry used in one embodiment of the present invention.

FIG. 1 is a schematic diagram depicting the control circuitry used in one embodiment of the present invention. Wall plug 1 is plugged into a wall socket with the wide blade end on the neutral or grounded side. The power from the neutral or grounded side is provided to both the controlled lamp 2 and the control circuit for triac 6 is interposed between the other wall socket connection and the controlled lamp 2. Five volt power to operate the microprocessor is derived from the 110 volt input through diode 8, resistor 10, zener diode 12 and capacitor 14. Diode 8 supplies semi-rectified current which is limited by resistor 10 which is approximately 10 kilo-ohms. Zener diode 12 has a zener breakdown voltage of approximately 5 volts and clamps the voltage between power supply point 16 and ground point 18 to 5 volts. Capacitor 14 has a capacitor value of approximately 200 microfarads which smooths out the semi-sinusoidal signal provided through diode 8 and provides a fairly high quality 5 volt positive voltage to power node 16. Because ground 18 is connected to the other side of a 110 volt power supply voltage, power supply node 16 floats at 5 volts above 110 volts AC power. Power supply voltage is also provided to microprocessor 20 through resistor 22 to all four input terminals (PCO-3) of port C of microprocessor 20. Resistor 22 is approximately 1 megohms which limits the current to a value which will not damage microprocessor 20. All integrated circuits contain voltage protection diodes which clamp voltage supplied above Vdd to Vdd +1.6 volts on the internal circuitry of the integrated circuit and similarly with voltages below 0 volts the voltage supplied to the integrated circuit is clamped to Vss −1.6 volts. Because of the input protection devices, what microprocessor 20 actually sees is a square wave input going from nominally 0 to 5 volts. Microprocessor 20 controls the operation of triac 6 through capacitor 24. During periods when triac 6 is off, output terminals PB0 through P85 are maintained at a high logic level, i.e., 5 volts. When microprocessor 20 is to turn on triac 6, output terminals PB0 through PB5 go to a logic 0 level, i.e. 0 volts. The charge stored on capacitor 24 is discharged into the P-type injection port of triac 6 which causes triac 6 to turn on. Output ports PB0 through PB5 then go back to 5 volts and capacitor 24 is recharged by internal leakage through triac 6.

Capacitor 26 sets the operating frequency of microprocessor 20. Microprocessor 20 includes internal clock generation with an external capacitor provided. In fabricated embodiments, microprocessor 20 is a Motorola HC 6804. Of course, the exact microprocessor used and the operating frequency and port configuration may be altered in any manner so long as required operating programming is provided. Capacitor 28 is connected to the reset input terminal to prevent stray fields from generated a reset signal in microprocessor 20. Input terminals PB6, PB7 and PA0 through PA7 are connected to the dim, low, L1 through 6, mid and high leads of touch switch 30.

Figure 2:
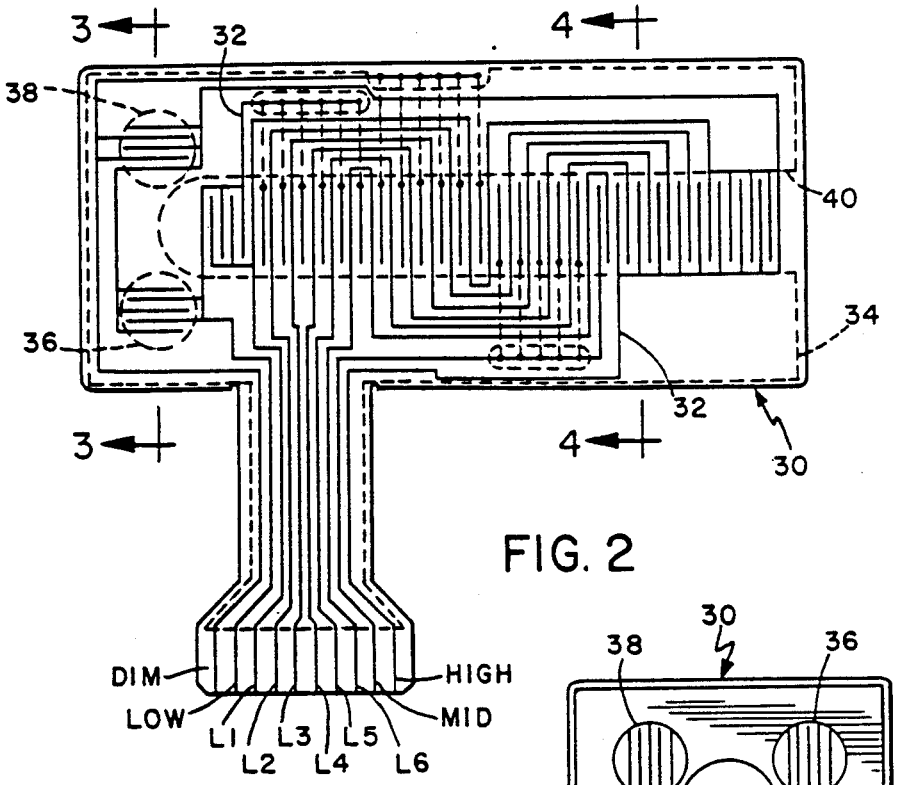
FIG. 2 is a schematic pattern diagram showing the routing of conductors in the membrane of the touch control switch.

A layout of the membrane portion of touch switch 30 is shown in FIG. 2. Lead dim, lead low, lead mid, and lead high cross dimmer area 40 covering 4 sections of dimmer area 40. Leads L1 through L6 interweave through lead dim, lead low, lead mid, and lead high in a serpentine fashion. Lead dim is interweaved with lead high in off area 38 and lead low and lead high are interweaved in timed off area 36. Printed insulator 34 covers all leads excepting in areas 36, 38 and 40. In these areas the leads are exposed.

Figure 3:
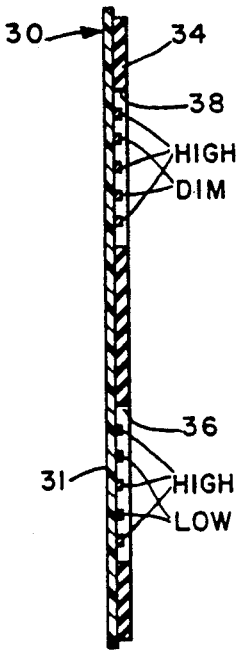
FIG. 3 is an enlarged sectional view taken on line 3—3 of FIG. 2.
Figure 4:
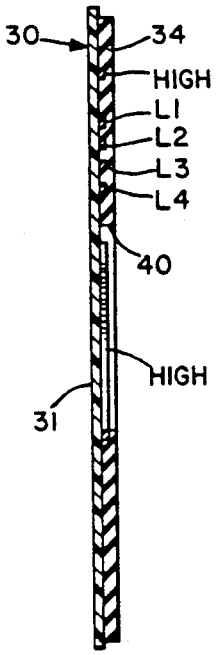
FIG. 4 is an enlarged sectional view taken on line 4—4 of FIG. 2.
Figure 5:
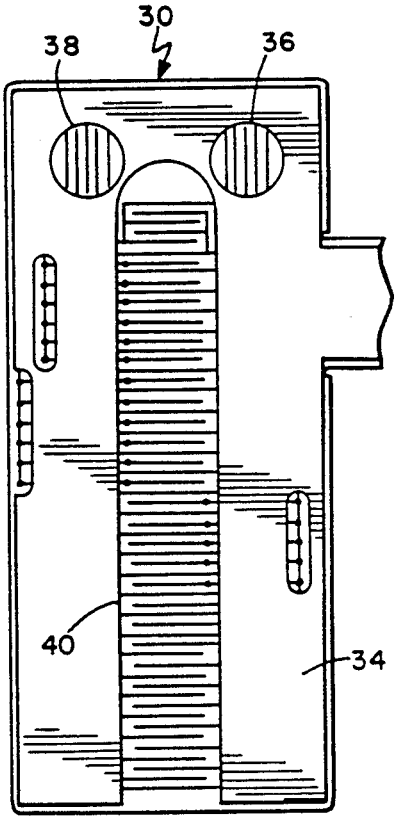
FIG. 5 is a view of the rear face of membrane 30 of FIG. 2.

FIG. 3 is a sectional view of membrane 30 showing the exposed low, dim and high leads. These leads are supported by substrate 31 but are not covered by insulation 34 in this section. FIG. 4 is a section of membrane 30 taken at line 4—4 of FIG. 2. FIG. 4 shows how leads L1 through L4 and lead HIGH are insulated by insulation 34 but lead HIGH is exposed in opening 40. FIG. 5 is a rear view of membrane 30 through substrate 31.

Figure 6:
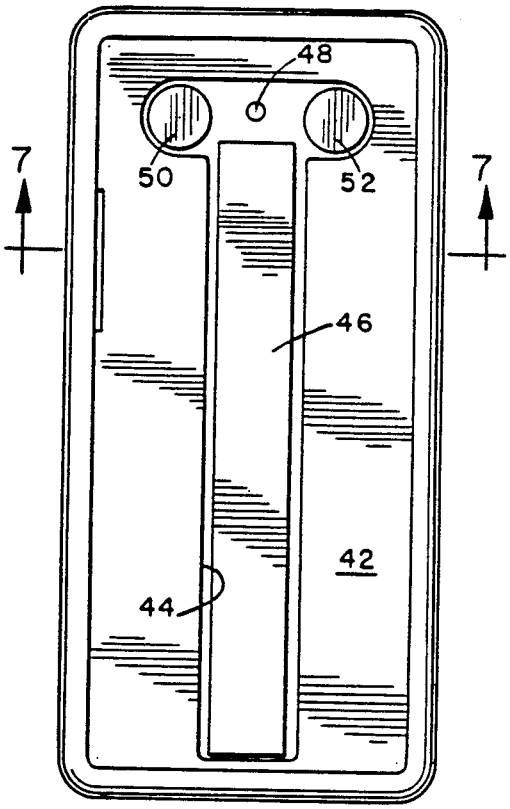
FIG. 6 is a top plan view of the base for membrane 30 of FIG. 2.

FIG. 6 is a top view of base 42. Recess 44 is a flat recess approximately 2 mils below the flat surface of base 42. Conductor area 46 is formed in recess 44. In a preferred embodiment conductor 46 is formed by carbonized paint. Conductors 50 and 52 are formed in a similar manner. Ventilation hole 48 is included to avoid alteration of the tolerances between membrane 30 (FIG. 2) and base 42 due to variations in ambient temperature and/or barometric pressure changes when membrane 30 is adhesively placed on the surface of base 42.

Figure 7:
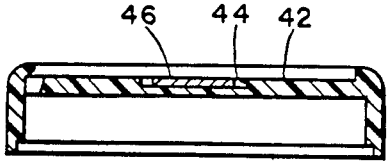
FIG. 7 is a sectional view taken on line 7—7 of FIG. 6.

FIG. 7 is a side view of base 42 and conductor 46.

Figure 8:
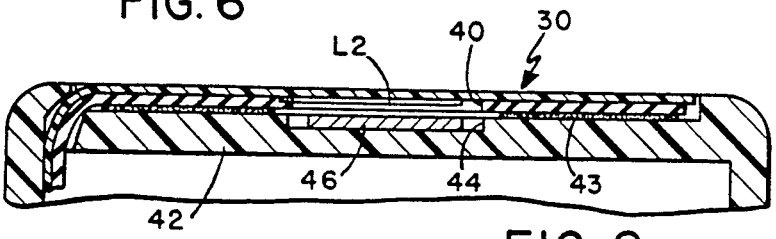
FIG. 8 is an enlarged sectional view similar to FIG. 7, with membrane 30 attached.

FIG. 8 is a side view showing membrane 30 attached to base 42 by adhesive 43. Because of the extreme rigidity of base 42, which is preferably formed with high rigidity plastic, this spacing tolerance between the exposed leads of membrane 30 and conductor regions 46, 50 and 52 can be very small. Because of this small tolerance, a very light touch, approximately one half ounce, is required to cause connection between the leads formed on membrane 30 and conductor regions 46, 50 and 52. Because of this tight tolerance, membrane 30 must be formed of a plastic such as mylar which is resistant to moisture and temperature alterations of size and shape. Membrane 30 must be fastened to the surface of base 42 using an adhesive 43 such as the 467 adhesive by 3M Corporation which is also moisture and temperature stable. In the described embodiment, adhesive 43 acts as a spacer between membrane 30 and base 42 to provide precise spacing between membrane 30 and conductor regions 46, 50 and 52. In another embodiment, adhesive 43 is made thicker, approximately 7 mils, and recess 44 is eliminated. In this alternative embodiment the adhesive itself provides all the required spacing between the conductors of membrane 30 and conductor regions 46, 50 and 52.

Figure 9:
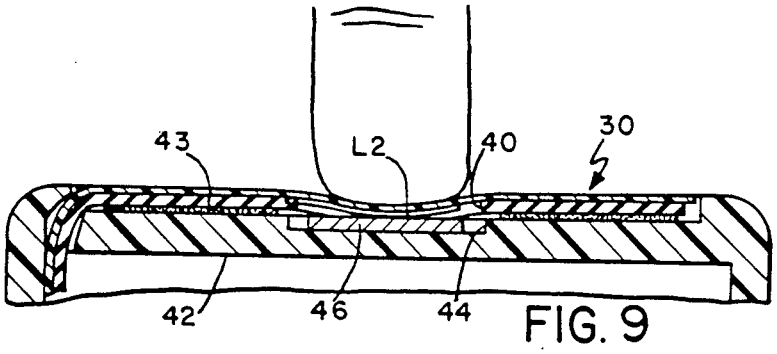
FIG. 9 is a view similar to FIG. 8, showing the contact action.

When pressure is placed on the membrane above conductor region 46, as shown in FIG. 9, one or more of leads of L1 through L6 will be shorted to one or more of leads dim, low, mid and high through conductor 46. Microprocessor 20 is programmed so that a logical 0 is place on one of leads dim, low, mid and high, successively. Leads L1 through L6 are normally at a logical 1. Microprocessor 20 then polls terminals PA0 through PA5 to determine if conductivity is present between the selected lead of dim, low, mid and high and one of leads L1 through L6. If continuity is found, that fact is stored in a register within microprocessor 20 and is used as timing data for triggering triac 6.

As the line voltage connected to plug 1 passes through one half cycle of the sinusoidal alternating current provided by wall current, microprocessor 20 (FIG. 1) detects the transition through input terminals PC0 through PC3. The operating frequency of microprocessor 20 is approximately 125 kilohertz which is approximately 2000 times the operating frequency of wall current. The HC 6804 microprocessor requires on the average four clock cycles to perform an instruction. Thus, microprocessor 20 selects a point in time from approximately 250 points in time of each half cycle of the provided line AC current. The longer triac 6 remains off during this half cycle, the less power is received by lamp 2 and the dimmer lamp 2 will be. Thus when the microprocessor 20 is set to provide a dim setting, microprocessor 20 delays up to 6.7 milliseconds before allowing triac 6 to turn on. In its bright setting, microprocessor 20 allows triac 6 to turn on 1.6 milliseconds after the initial point of the half cycle. This 1.6 millisecond delay is used to allow microprocessor 20 to poll the leads of membrane 30 to determine if a new dimmer setting is selected.

Of the 26 combinations between leads dim, low, mid and high and leads L1 through L6, 2 define "off" and "delay-off" and 24 define gradations of brightness for lamp 2. The differences in brightness between adjacent levels are very difficult to perceive by the human eye, thus the dimming action seems to be a continuous scale. Because of the light touch and the continuous scale appearance of the dimming system, the described embodiment provides a lamp dimming system with the tactile qualities of touch lamp control and the aesthetic qualities of continuous dimming.

When the user Wishes to turn the lamp off immediately, the portion of membrane 30 labeled area 38 in FIG. 2 may be pressed. Microprocessor 20 of FIG. 1 polls lead dim and lead high to determine if there is conductivity between these two leads. If microprocessor 20 detects such conductivity no firing signal is provided for microprocessor 20 to triac 6 and lamp 2 remains off. If area 36 of membrane 30 is pressed, microprocessor 20 detects conductivity between lead low and lead high and enters the delay off program. Microprocessor 20 then determines the brightness setting and lowers the brightness setting to a preselected level commensurate with that brightness setting. The preselected level is programmed in the read only memory of microprocessor 20 and is selected so that perceptible dimming is provided no matter what the brightness setting of lamp 2 may be. Microprocessor 20 then counts a fixed period of time before lamp 2 is completely shut off. During this time, microprocessor 20 polls the leads of membrane 30 to determine of the user has changed his/her mind and has provided a new brightness setting.

Although specific embodiments are herein described, the use of specific embodiments is not to be construed as limiting the scope of the invention. The scope of the invention is limited only by the claims appended hereto.

I claim:

1. A low pressure electrical switch comprising:

a flexible membrane;

a plurality of spaced apart electrical pattern conductors disposed in a continuous single column array upon a first surface of said membrane;

a plurality of electrically conductive range leads disposed upon said membrane, each range lead coupled to alternate ones of said pattern conductors in a respective region of said conductor array;

a plurality of electrically conductive level leads disposed upon said membrane, each level lead coupled to a respective other one of said conductors in each respective region of said conductor array;

a rigid member having a flat surface, a recessed portion of said rigid member surface aligned and facing said conductor array; and a fixed conductor formed in said recessed portion, said membrane being attached to said rigid member with said conductor array suspended over said recessed portion so that certain ones of said pattern conductors come in contact with said fixed conductor when pressure is applied to a second surface of said membrane above said recessed portion.

2. A low pressure electrical switch as in claim 1 wherein said flexible membrane comprises a mylar membrane.

3. A low pressure electrical switch as in claim 1 further comprising a spacer placed between said flexible membrane and said rigid member providing precise spacing between said pattern conductor and said fixed conductors.

4. A low pressure electrical switch as in claim 1 wherein said fixed conductor is formed by depositing a carbon conductor in said recessed portion.

5. The low pressure electrical switch of claim 1 further comprising a spacer layer disposed between said rigid member and said membrane, said spacer layer having an open portion aligned with said conductor array and said fixed conductor.

6. A low pressure electrical switch comprising:

a flexible membrane;

a plurality of parallel spaced apart straight electrically conductive segments aligned in a continuous single column linear array on a lower surface of said membrane;

a plurality of electrically conductive range leads disposed upon said membrane, each range lead coupled to alternate ones of said conductive segments in a respective adjacent region of said array;

a plurality of electrically conductive level leads disposed upon said membrane, each range lead coupled to a respective other one of said conductive segments in each respective adjacent region of said array;

a rigid member coupled to said membrane, said rigid member having an upper surface facing said membrane lower surface;

a spacer layer disposed between said rigid member and said membrane, said spacer layer having an open portion aligned with said array; and a fixed conductor formed on said rigid member upper surface and aligned with said spacer layer opening, said array suspended over said fixed conductor so that certain conductive segments come in contact with said fixed conductor when pressure is applied to an upper surface of said membrane above said array.

7. A low pressure electrical switch as in claim 6 wherein said flexible membrane comprises a mylar membrane.

8. A low pressure electrical switch as in claim 6 wherein said fixed conductor is formed by depositing a carbon conductor in alignment with said opening of said spacer layer.

9. A low pressure electrical switch as in claim 6 wherein said spacer layer comprises adhesive material.

* * * * *